US005482467A

United States Patent [19]

Nolf et al.

[11] Patent Number: 5,482,467

[45] Date of Patent: Jan. 9, 1996

[54] ELECTRICAL CONNECTOR

[75] Inventors: Jean-Marie E. Nolf; Jan L. Vansant, both of Korbeek-Lo; Joris I. Franckx, Bonheiden; Reza Zadno, Overijse, all of Belgium

[73] Assignee: N.V. Raychem S.A., Kessel-Lo, Belgium

[21] Appl. No.: 303,294

[22] Filed: Sep. 8, 1994

Related U.S. Application Data

[63] Continuation of Ser. No. 915,998, filed as PCT/GB91/00127 Jan. 29, 1991, abandoned.

[30] Foreign Application Priority Data

Jan. 31, 1990 [GB] United Kingdom ..... 9002172

[51] Int. Cl.[6] ..... H01R 4/24

[52] U.S. Cl. ..... 439/161; 439/395; 439/521

[58] Field of Search ..... 439/161, 395, 439/521

[56] References Cited

U.S. PATENT DOCUMENTS

| | | | |
|---|---|---|---|
| 4,487,465 | 12/1984 | Cherian | 439/161 |
| 4,505,767 | 3/1985 | Quin | 148/402 |
| 4,639,060 | 1/1987 | Lionnet | 439/161 |

FOREIGN PATENT DOCUMENTS

| | | | |
|---|---|---|---|
| 43437 | 1/1982 | European Pat. Off. | 439/395 |
| 2095480 | 9/1982 | United Kingdom | 439/161 |

*Primary Examiner*—Steven C. Bishop
*Attorney, Agent, or Firm*—Herbert G. Burkard; William D. Zahrt, II

[57] ABSTRACT

An electrical connector, particularly an insulation-displacement connector of split-beam design, comprising a metal that at constant temperature has an elasticity of at least 0.8%. This allows the connector to be used with conductors over a large diameter range.

33 Claims, 3 Drawing Sheets

ELECTRICAL CONNECTOR

This application is a continuation of application Ser. No. 07/915,998, filed as PCT/GB91/00127, Jan. 29, 1991, now abandoned.

The present invention relates to an electrical connector, particularly an insulation-displacement connector, and especially one suitable for use in a telecommunications terminal block.

Electrical connections of widely different design are employed in telecommunications and other electrical systems, and the problems faced and solutions sought are equally varied. The invention will be described primarily in terms of the problem faced by the present inventors, namely how to produce a telecommunications block of small size that can deal with a high pair count and can accept conductors of widely varying size. Nonetheless, the invention is likely to find other useful applications.

Telecommunications cables, which may contain many hundreds and sometimes thousands, of pairs of conductors are terminated at, for example, telephone central offices and in distribution points such as pedestals or cabinets where final connections are made to smaller cables or to drop wires that lead to subscriber equipment. The conductors of a distribution cable may be connected more or less permanently to connectors of a so-called terminal block, to which subscriber drop wires may be connected generally in a way that allows relatively easy removal. A terminal block may comprise a housing that contains an array of terminals (for example 5,10,25 or 50 pairs for example), each having the form, for example of a post. The conductors from the cable may be wire wrapped or otherwise fixed to a bottom of the post that is exposed at the base of the housing. Those connections may then be potted in a curable resin to avoid environmental damage. The tops of the posts may be provided with screw threads over which nuts or caps may be screwed to secure the drop wires to the subscribers. In this way, the cable is connected to the subscribers. A disadvantage of such a design is that the drop wires (and the conductors of the distribution cable) have to be stripped of insulation at their ends before connection to the posts is made. That can be an awkward and lengthy job.

Terminal blocks have been designed employing contacts that automatically make connection to insulated wires. Such contacts are called insulation-displacement connectors (IDC). They may contain a slot in a flat piece of metal into which slot the wire is transversely forced. The slot is of exactly the correct size such that the conductor of the wire can pass along it without damage but the insulation is cut-through or otherwise displaced, so that the edges of the metal contact the conductor. A terminal block containing such "slotted-beam" insulation displacement connectors is disclosed in U.S. Pat. No. B1 3,708,779 (3M) and U.S. Pat. No. 3,798,587 (Bell Telephone Laboratories), the disclosures of which are incorporated herein by reference.

U.S. Pat. No. 3,798,587 had as its object to provide improvements to earlier miniature connectors (U.S. Pat No. 3,611,264) to facilitate identification of conductors, and to allow repeated use of an IDC without conductor damage. A further object was to make connections between conductors over a wide range of gauge sizes. Slotted-beam IDCs are disclosed with a specially shaped conductor-receiving aperture, but no indication appears to be given as to how different gauge conductors are to be accommodated.

Various other prior art references disclosing slotted-beam IDCs will now be mentioned, the disclosure of each of which is incorporated herein by reference.

U.S. Pat. No. 4,062,614 (Bell Telephone Laboratories) discloses an IDC apparently of increased strength to allow repeated use and acceptance of a predetermined range of wire sizes. The IDC is bifurcated, and each of the furcations has a chisel-like cutting edge at its tip. It may be made for example of phosphor bronze or spinoidal copper.

U.S. Pat. No. 4,136,628 (Western Electric Company) also discloses a phosphor bronze or spinoidal copper slotted beam IDC. An opening is formed in a metal strip and forces are applied adjacent the opening to cause reshaping. A bifurcated beam is then formed, and the furcations moved towards each other to form a slot of predetermined width. Selected portions of the furcations may be coated or plated and/or treated prior to moving the furcations to their final closed position.

U.S. Pat No. 4,611,874 (Krone) discloses a slotted-beam IDC, particularly for aluminium and multiwire copper conductors, which is capable of accommodating different wire gauges. That is said to be achieved by means of a contact slot the air gap of which is designed for automatic adaptation (for example when the conductor material ages) and which always ensures sufficient contact pressure. The connector is of X-shaped cross-section and formed such that the conductor wire can be inserted centrally into a slot via two insertion openings each of which includes a substantially v-shaped centering portion and an off-set insulation-cutting edge. The size of the conductor and the size of the slot determine the contact pressure. Difference gauge wires are accommodated in further embodiments simple by adapting the width of the slot to match the wire, and a given device will not therefore solve the problem faced by the present inventors.

CA 1115796 (Northern Telecom Ltd/discloses a slotted beam IDC of particular shape, allegedly overcoming poor elastic compliance and non-uniformity of stress distribution of prior art IDCs where stress is concentrated at the proximal ends of the beams. In this design the beams taper towards a mid-point thereof such that the upper parts (above the waist) are plastically deformed past the elastic limit of the material during the action of stripping of a wire that is inserted into the slot. The high stresses during stripping are therefore distributed in the upper portions of the beams, the lower portions (where the stripped conductor will reside) being uniformly stressed to a lower extent. The result of the tapering is said to be improved specific volume efficiently and increased elastic compliance.

Difference gauges of conductor are dealt with in the slotted-beam IDC of GB 2084813 (Wago Verwaltungsgesellschaft) by providing beams which are graduated in stepped manner, such that the different portions of the slot have different widths.

In U.S. Pat. No. 4,826,449 (Northern Telecom Ltd) a slotted-beam IDC is disclosed that apparently can accept a range of conductor sizes (the range 26–18 AWG is mentioned) and can accept many removals and re-insertions of the wire, this combination being generally unknown in previous designs. This is achieved by providing a protrusion extending inwardly from each beam to the other at about mid-way along their lengths to pre-stress them in the direction of their separation, and also a projection on the outer edge of each beam, again at about mid-way along its length which acts as a fulcrum contacting the wall of a cavity in which the IDC is positioned. The features of CA 1115796, mentioned above, are also provided.

It may perhaps be noted from the above review that effort has been expended on design of an IDC that will allow connection to a range of conductor gauges, without damage to the conductor. Also it might be noted that IDCs have been employed in terminal blocks, and the desire for miniaturization has been expressed.

Nonetheless, we were still faced with the problem of designing a simple terminal block for many conductors where overall size was limited, and we desired the advantage of reduced inventory etc. where an IDC can accommodate a wide range of conductor gauges. We realized that a large IDC could accommodate a range of conductor sizes since the IDC is not forced to deform to a great extent on insertion of a conductor, and the force acting on each of a small and large conductor can be kept within safe limits. We then realized that IDCs made from steel, copper, beryllium-copper and other highly conductive metals could not be made very small since they would be forced to deform beyond their elastic limit (less than 0.5% and often from 0.2–0.4% at most), and hence an insufficient force would be exerted by the beams of the IDC on the conductors. There would be no, or little, stored energy in the IDC and a high contact resistance would be the result, probably immediately and certainly after a short period use.

This problem was overcome by employing as at least part of the connector a superelastic metal, which allows a large range of insulated conductor size (say a factor of at least 1.5, preferably at least 2.0, more preferably at least, say, 3.125, such as from 0.4–1.25 mm) to be accommodated in a small IDC, say one having a slot of length less than 10 mm, preferably about 6 mm. The metal of the connector preferably has a thickness of from 0.3 to 0.7 mm, preferably at least at a region where deformation occurs and/or at a region where insulation displacement occurs and more preferably all over. In use the connector can have a large stored energy, allowing good electrical connection to be maintained inspite of creep or movement of the conductor or of parts of the connector.

Thus, the invention provides an electrical connector comprising a metal that, preferably at constant temperature, has an elasticity (or recoverable strain) of at least 0.8%, preferably at least 1.5%, more preferably at least 2% particularly at least 3%, especially at least 3.5%. The figures for elasticity given in this specification relate to tensile testing. The connector preferably has an electrical contact (which may but need not comprise at least part of said metal) through which current flows in use. The connector will preferably therefore have an electrical function as apposed to a mere mechanical function.

The connector is preferably an insulation-displacement connector, in particular one of slotted-beam design. The two (or more) beams may be separate from one another, may be joined together for example at their bases, or may be integral.

Thus the invention further provides a slotted-beam insulation-displacement connector comprising a metal that has an elasticity of at least 0.8%, against which elasticity the connector is deformed when a conductor to be connected thereto is forced into its slot.

The connector preferably comprises:

(a) an insulation displacement surface;

(b) a retaining surface; and (c) the metal, positioned to control the positions of the displacement surface and the retaining surface relative to one another.

The retaining surface may have an insulation-displacing function, and vice versa, and thus the two surfaces may be substantially identical. Preferably, the two surfaces comprise parts of respective beams of a slotted-beam IDC.

In order to explain the invention more fully, it may be useful here to review various prior art IDCs which employ metals that undergo large strain, but which are otherwise different.

Shape memory alloy, (SMA ), have been used in small electrical connectors such that a heating step carried out on the connector causes automatic stripping of wires therein and, if desired, melting of solder within the connector to form an electrical connection between the wires.

Shape memory effect has been known in metals for over 50 years, it being first observed in brass at Harvard and MIT in 1938. A similar effect was noted in a nickel-titanium alloy in 1962. What is required is an alloy that can exist in two crystalline phases, namely austenite (the high temperature phase) and martensite (the low temperature phase) and has the ability to undergo a reversible, diffusionless transformation between the two. The martensite formed at low temperatures should have a highly symmetrical crystal structure allowing considerable distortion under applied stress. A product is formed in its desired installed shape from such a material, and is then subjected to stress to distort it into its "as-supplied" shape. Most of this distortion is not recovered on removal of the stress, at constant temperature. Thus, a product such as a wire stripper may be sold in the distorted configuration, which is stable at a given temperature, preferably ambient temperature. On heat-installation of the product the martensite phase reverts to the high temperature austenite phase and the original shape is recovered.

The following patent specifications may be referred to, each of which is incorporated herein by reference: GB 2146854 (Raychem), U.S. Pat. No. 4510827 (Raychem) EP 0129339 (Raychem), PCT GB 89/00601 (Raychem) and EP 0123376 (Hitachi).

GB 2146854 discloses a wire-stripping arrangement for use in an electrical connector comprising a heat-recoverable memory metal member arranged on heat-recovery to urge an insulated electrical conductor on to cutting edges such that the cutting edges penetrate the insulation.

U.S. Pat. No. 4,510,827 discloses a recoverable arrangement for stripping insulation from an elongate insulated conductor which comprises two stripping members each of which has a cut-out portion. The cut-out portions are arranged to overlap so as to form an aperture to receive the conductor. The arrangement is heat-recoverable such that the stripping members move laterally of the conductor to pierce the insulation, and longitudinally to strip the insulation.

EP 0129339 discloses a connector for making an electrical connection to the conductor of an elongate insulated electrical conductor, which comprises contact members that are electrically conductive at least in part and which overlap to define an aperture for receiving the insulated conductor, the connector being recoverable in such a way that the members slide relative to one another so that the aperture is reduced in size, so as in use to cause at least one of the members defining the reduced size aperture to pierce the conductor insulation, and the members to exert a permanent gripping force on the conductor. The contact members themselves may comprise a memory metal. Permanent gripping force of the connector is preferably provided by a selective memory metal having a transition temperature below the normal operating temperature of the connector in service. Thus, in service the memory metal is above its transition temperature and therefore exerts a permanent gripping force. However, the normal operating temperature in service will generally be similar to the storage temperature of the connector before use; and the memory metal will therefore be in its high temperature state during storage and hence attempting to recover. Means for temporarily preventing recovery may, however, be provided comprising a restraining element or detent which is arranged to prevent relative movement of the members until installation. An alternative to providing a mechanical restraining element is to "precondition" the memory metal thereby raising its transition temperature for a single heating cycle. Thus, during storage the metal is below its (temporarily raised) transition temperature, and it remains in the recoverable, martensite, phase. On heat installation it recovers to the austenite phase, which is then stable at ambient temperatures since the transition temperature has now reverted to its previous low value.

EP 0123376 refers to an earlier shape memory connector which relies on a spring to cause it to return to an initial shape when in the soft, martensite phase. A one-way shape memory effect is utilized, resulting in a large deformation, the spring providing deformation in the other direction. Where a large number of connectors must be provided at high density each connector must be small, and reduction in size of this earlier connector is limited due to the need for the spring. What is proposed is a connector having a connection terminal of a shape memory alloy characterized in that the connector includes an insulator substrate having a hole therein, and in that the connection terminal comprises a thin sheet of the shape memory alloy on the substrate, the terminal having a gap portion for insertion of the pin. The following comment is made concerning memory metals. Where a force is applied to an alloy to cause its deformation within a temperature range where the martensite phase is stable, strain increases in accordance with stress but when the stress reaches a certain value the strain thereafter increases without a corresponding increase in the stress. It is then said that this phenomenon is analogous to the yield of an ordinary material and is referred to as "pseudoelastic behavour", and can be distinguished from ordinary plastic deformation because the alloy assumes its original shape if this stress is released within a certain strain range. This statement is of course clearly incomplete in that once the metal has been deformed in a pseudoelastic region (ie where strain increases without corresponding increase in stress) it will require heating if the original shape is to be recovered. This is because the original deformation was said to be carried out at a temperature where the martensite phase was stable, and as a result that phase will still be the stable phase after the deformation. The alloy will require heat-transformation to the austenite phase to recover its shape.

For completeness, reference may be made to linear superelastic and non-linear superelastic (pseudoelastic) metals used to clamp a braid around a cable. The clamp itself has no electrical function and no current would pass through it. It merely has the function of mechanically forcing the braid around the cable. PCT GB 89/00601 discloses a clamp comprising a split ring made from a memory metal which exhibits superelasticity with at least 4% recoverable strain, the ends of the split ring having been moved relative to each other to render the ring recoverable. The clamp may be installed by heating or by removal of a hold-out tool, depending on ambient temperature. Non-linear superelasticity is said to be associated with the formation and reversion of stress-induced martensite from an alloy initially in the austenite phase but at a temperature below $A_S$ (that at which austenite begins to form on heating). Linear superelastic behavour, which does not involve an austenite/martensite phase change, is said to result from deformation caused by cold-working.

The metal employed in the present invention, which preferably forms one or both beams of a two beam IDC, may comprise a linear superelastic metal or a non-linear pseudoelastic metal. The former is preferable for many applications because its behaviour is less temperature dependant. It will be desirable that the IDC applies a force to a conductor within the diameter range 0.4–1.25 mm of at least 0.6, 1, 2 or 3 kg and of less than 10,8 or 7 kg over a temperature range −20° C. to 85° C. The metal may be any suitable alloy and is preferably one having martensite and austenite phases. When the metal is to have linear superelasticity it is preferably produced by cold working a metal in the martensite phase, which introduces dislocations into the crystal structure which facilitates migration of so-called twin boundaries under stress. A structural change therefore occurs which may be referred to as a martensite-martensite transformation, leading to an elastic strain for many systems of up to about 4%. Cold working may also make the metal stronger and we prefer that such metals exhibiting linear superelasticity show an average modulus of between 30000 and 60000 preferably between 45000 and 55000, for example about 50,000 MPa over its elastic deformation region and preferably at 2% strain. Where the metal is to have non-linear superelasticity, an alloy is chosen having $A_S$ (the temperature at which austenite begins to form on heating) below ambient temperature, and having an ability to be transformed to martensite on the application of stress. Initially on application of stress there is an elastic deformation of the austenite material, which then transforms to martensite which itself undergoes a transformation. If the stress is released before plastic deformation of the deformed martensite occurs, the metal will return to its original austenite shape. Pseudoelastic deformation of up to about 8% can be achieved in this way. The average modulus of such metals may be determined by taking the gradient of the stress-strain curve that runs from the end of the plateau to the origin. Thus defined, a straight line on the modulus should have a minimum value of at least 4000 MPa.

The skilled reader will be able to formulate various alloys suitable for use in the present invention. At present, however, we prefer an alloy comprising nickel and titanium, preferably from 48–51 atomic % Ni the remainder being Ti or Ti and minor amounts of other metals. Other elements may be added to alter the transition temperatures, or to improve strength or maximum elastic strain, for example 3–8 atomic % Cu. In general, four systems may be considered: Ni—Ti binary; Ni—Ti—Cu; Cu—Zn—X, where X is Si, Sn, Al, Ga, or Zn etc; and Cu—Al—Ni. In the first three of these systems the austenite phase is of B2 type, and in the fourth it is of DO3 type.

In a preferred embodiment, introduced above, the invention provides an IDC comprising:

(a) an insulation displacement surface, having for example a cutting edge, and through which current preferably flows in use;

(b) a retaining surface which in general will force a conductor against the displacement surface as it is manually or otherwise slid along that surface and/or will force the conductor during service against an electrical contact to maintain a low contact resistance; and (c) the metal positioned to control the positions of the displacement surface and the retaining surface relative to one another, and generally to provide the force referred to above.

The displacement surface may have a retaining function, and the retaining surface may have a displacement function, and in fact the two surfaces may be substantially identical and form the two beams of a slotted beam IDC. The metal may be part of one or both beams, or may Join the beams together, or otherwise act on one or both of them.

The displacement surface and the retaining surface may be positioned relative to one another such that an electrical conductor can be forced between them causing elastic strain of the metal. We prefer that it is the act of moving the conductor along the displacement surface that causes elastic deformation of the metal, and that the resulting stress in the metal forces the conductor against the displacement surface. The force acting on the conductor to cut through or crush the insulation, and subsequently to maintain electrical contact is thus provided by the metal in its attempt to relax. That force results however from the force applied by the installer in pushing the conductor into the connector. That is preferably done manually, with or without the aid of a tool or some other part of the connector. This mode of operation may be contrasted with that disclosed, for example in U.S. Pat. No. 4,510,827 which is effectively a zero insertion-force connector, and in PCT GB 89/00601 which involves relaxation of a prestressed clamp.

The invention therefore provides a method of making an electrical connection which comprises:

(1) providing an electrical connector having an electrical contact and comprising a metal that at constant temperature has an elasticity of at least 2%;

(2) positioning an electrical conductor adjacent the electrical contact; and (3) forcing, preferably manually, the conductor into contact with the contact against the elasticity of the metal.

That method may form the basis for various methods of making an electrical connection between two electrical conductors. In a first preferred method each of the conductors is connected to a respective electrical contact by the basic method given above, and (before or afterwards) the two electrical contacts are connected together. The two contacts may be interconnectable by a switch comprising for example two conductive surfaces that are resiliently biased to contact one another, but are separable from one another, for example by forcing an insulator between them. Alternatively the switch may comprise two conductive surfaces fixed apart from one another, the two conductive surfaces having means for retaining a conductor that can bridge them. In a second preferred method one of the conductors is connected to an electrical contact by the basic method given above, and the other electrical conductor is connected to a part of the electrical connector remote from a part of the contact to which the first-mentioned conductor is or is to be connected. These or other features may be provided to allow separate electrical testing of the circuitry connected to each conductor, for example of the line leading to a subscriber and of the line leading to a central office.

A slot in the slotted-beam IDC or other connector of the invention may have two or more parts, optionally of different size and/or shape. For example the slot may taper at its open end away from the open end to act as a guide for transverse insertion of a conductor. Next in the direction of the closed end, a second portion of slot may be substantially parallel-sided or gently tapered to provide an insulation-displacement region where the inward edges of the beams (or one of them) are sufficiently sharp to cut through or crush the insulation. A third portion of slot will generally be substantially parallel-sided and it is here that the conductor will in general finally reside with good electrical connection to one or both beams, for which purpose the beams may be coated with, for example, silver to reduce contact resistance. The base of the slot may be cut away to an arc of a circle for stress relief. Preferably such an arc has a radius greater than half the width of the slot, preferably 0.1 to 0.5 especially about 0.3 mm, and an extent of greater than 180°, preferably greater than 270°. The second and third portions may be substantially identical.

The connectors of the invention are preferably provided as part of a connection apparatus such as a telecommunications block. The connectors may be arranged in an array of, say, at least 10 preferably 20, 50 or 100. The block may have means to locate an incoming cable or conductors thereof, and/or means to locate and/or organize outgoing drop wires or other conductors that are connected by means of the invention. The connectors are preferably present in the block at a high density. The block may be modular, for example having a first layer or other part containing the connectors, and a second layer or other part into which a plurality of conductors may be arranged such that when the two layers are brought together each of the plurality of conductors is simultaneously forced into a respective connector. A third layer or other part may be provided into which a second plurality of conductors may be arranged. The second plurality may be from a distribution cable for example, the first-mentioned plurality being drop wires to subscribers. As a result, when the third layer is brought together with an opposite side of the first layer, conductors of the second plurality are connected to the connectors, or to other connectors which are in turn connected to the first-mentioned connectors.

The connectors, or a terminal block containing them, may be provided with electrical protection such as a fuse or fast-acting switch that can isolate the conductors at either side of the block (and therefore the subscriber and/or central office in the case of a telecommunications block) in the event of an overvoltage, for example from the mains or from a lightening strike. Alternatively, a fast acting switch could shunt such overvoltage to earth.

A connector or block may be provided with environmental protection, against moisture or other contaminants. Such protection may comprise a housing (for example a heat-shrinkable plastics housing) and/or a sealing material such as a gel or an adhesive. A gel is preferred, and it may be provided around the various connectors and contacts, particularly such that a conductor is forced through the gel when the connection is made. Some restraining means may be provided to keep the gel in place, preferably maintaining it under compression. Gels are disclosed in U.S. Pat. No. 4,634,207 (Raychem) the disclosure of which is incorporated herein by reference.

The invention is further illustrated by the accompanying drawings, in which.

Figure 1:
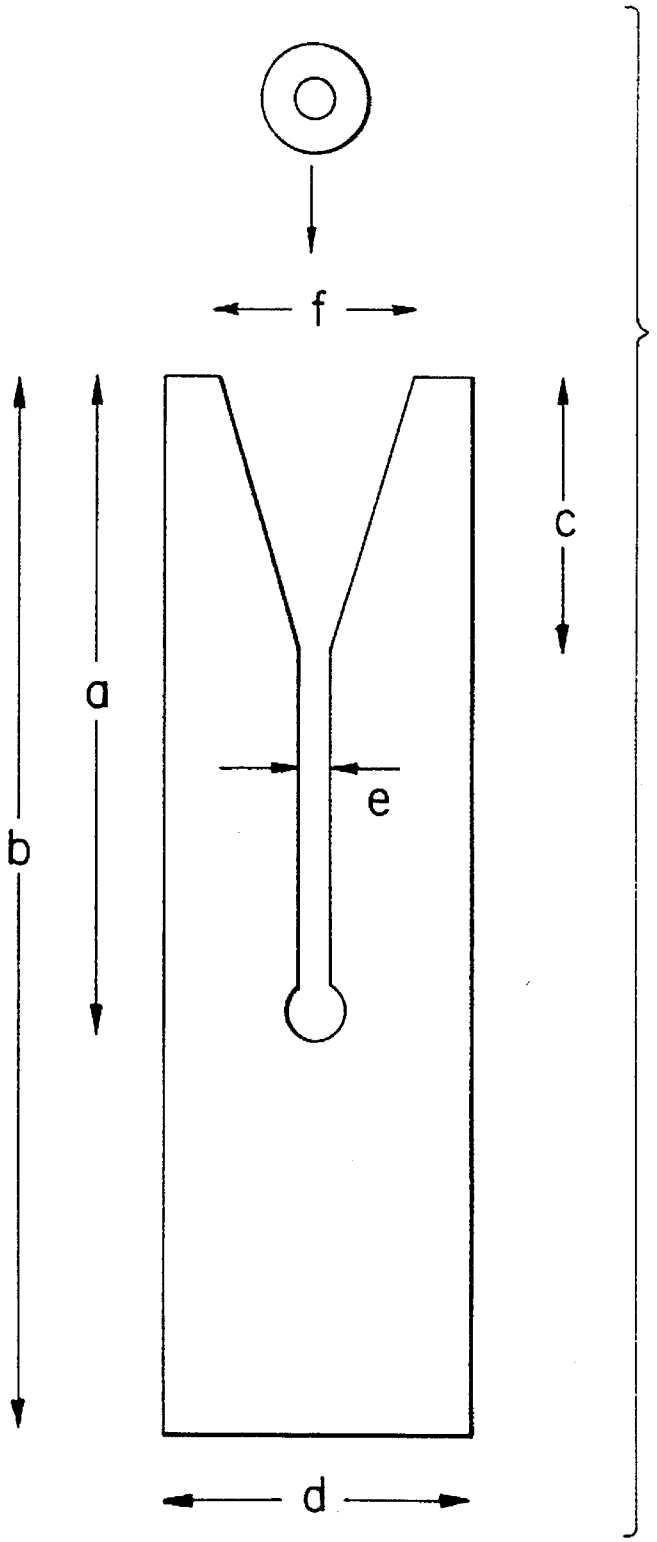
FIG. 1 shows a slotted beam IDC.

FIG. 1 shows a slotted-beam IDC preferably made of a nickel-titanium alloy, particularly in its cold-worked martensite phase. The two circles above the IDC show to scale the preferred minimum and maximum conductor sizes (0.4 and 1 mm respectively) with which the IDC is to be used. The conductors are, of course, inserted by moving them transverse to their length, downwards as drawn, into the slot as shown by the arrow. The inwardly facing surfaces of the beams therefore function as electrical contacts. The dimensions are preferably as follows; each being given as ranges in order of preference:

a. 3–9 mm, 4.5–7.5 mm, 5.5–6.5 mm.

b. 5–15 mm, 7–13 mm, 8.5–11.5 mm.

c. 1–5 mm, 1.5–3 mm.

d. 1–7 mm, 1.5–5.0 mm, 2–3.5 mm.

e. 0.3–1.0 mm, 0.3–0.7 mm, 0.35–0.5 mm.

f. 0.5–2.5 mm, 1.0–2.0 mm, 1.5–2.0 mm.

Radius of stress-relief hole 0.15–1.5 mm, 0.2–0.75 mm.

The alloy preferably is a binary nickel-titanium alloy having at least 49 atomic % nickel.

An IDC was made from such an alloy of thickness about 0.5 mm, and having the following dimensions.

a. 6 mm b. 10 mm c. 2.5 mm d. 3 mm e. 0.35 mm f. 1.95 mm

Radius 0.3 mm

It was able to accept wires of diameters from 0.4 to 1.0 mm, a range of a factor of 2.5.

Prior art IDCs of similar shape can only accept a range 0.4 to 0.65 and they are about twice as large, at least as regards dimension b. With a wire of 1 mm diameter, the present IDC had a maximum strain of 3.3% and a maximum stress of 211 $kg/mm^2$, which is well within the material limits, in fact about 86% thereof. The beams of the IDC were coated with silver since the nickel-titanium alloy has poor electrical qualities, and excellent performance was achieved.

Figure 2:
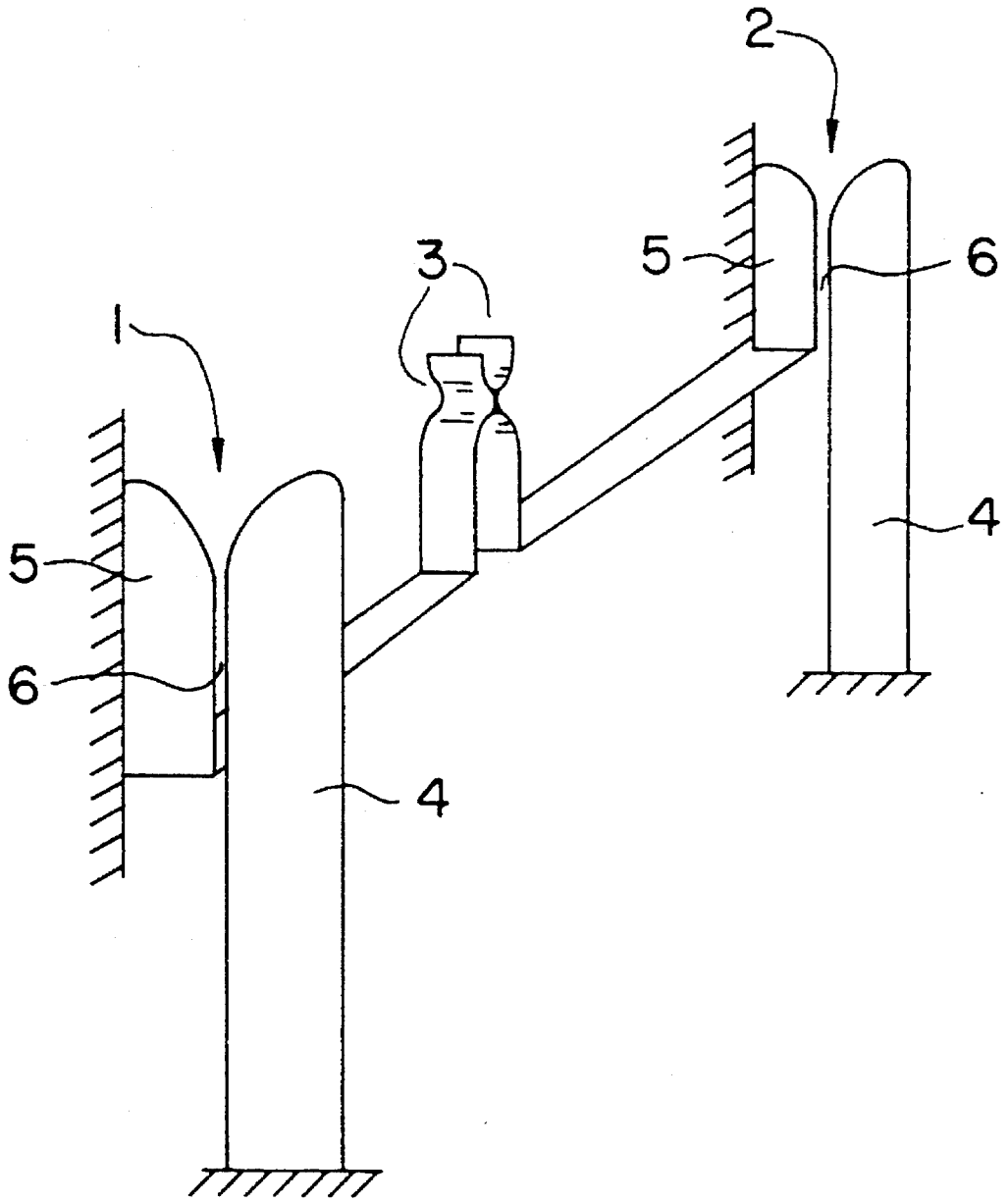
FIG. 2 shows an alternative design of slotted-beam IDC.

FIG. 2 shows two slotted beam IDCs 1,2 which are electrically connectable together by a switch 3, but which may be used separately or with other designs of switch. The switch shown comprises conducting surfaces that are biased together but that can be separated for example by inserting an insulator between them.

Each IDC comprises two beams 4 and 5 that need not be joined together electrically, or in fact at all. They are each shown, by means of the shading to be fixed rigidly to a housing within which the connectors are provided. A part of a housing (which may be dedicated to the purpose and not have any enclosing function) or other component may therefore contribute to the functioning of the connector, by for example taking part in insulation-displacement and/or electrical conduction and/or provision of force. Such part may comprise an elastic polymer etc. The beams comprise the metal of high elasticity, and the beams 5 may comprise a normal metal of low elasticity but high conductivity such as copper, or beryllium copper etc. The beams 5 may remain fixed, all elastic deformation occurring in beams 4 as the conductors are forced into slots 6. In this way the various functions of the IDC have been separated. Also, manufacture may be simpler since the need to stamp a slot in a single piece of metal is avoided, and the edges of the separate pieces can be prepared carefully and then set a precise distance apart. Also, if desired the rest position of the two beams may be such that they touch, or are biased together. An analagous result may be provided in the connector of FIG. 1 by pre-stressing, but this might involve a more complex manufacturing process.

Figure 3:
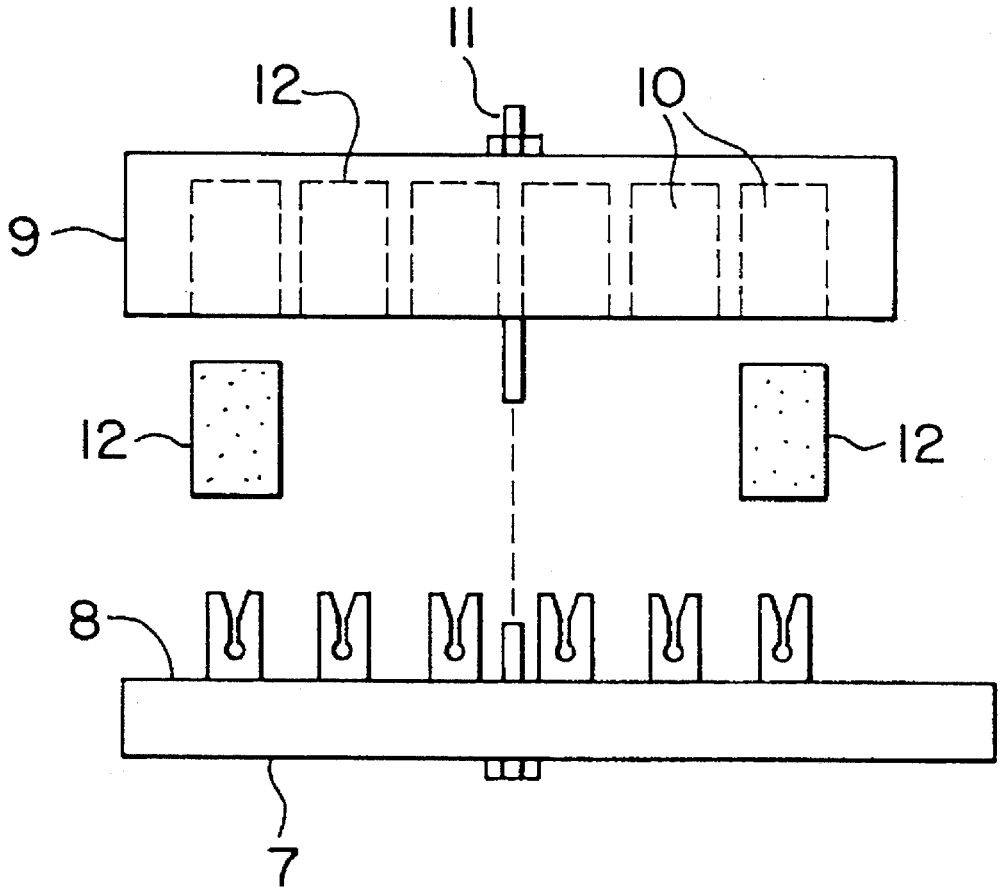
FIG. 3 is an exploded view of an array of connectors according to the present invention.

FIG. 3 shows a base 7 carrying an array of insulation displacement connectors 8 according to the invention. The connectors 8 may be connectors of the type shown in FIG. 1. A cover 9 has recesses 10 corresponding to the connectors 8. The cover may be fixed to the base 7 by a bolt 11 to form a housing for the connectors. The recesses 10 are filled with plugs 12 of gel. When wires (not shown) are inserted into the connectors 8 and the cover is forced down on to the base and secured to it, the gel will be displaced around each connector and wire so as to assist in providing an environmental seal.

For the avoidance of doubt it is noted that the invention provides a connector particularly an IDC, a connector device, a connection apparatus such as a terminal block and methods of connecting employing metals of high elasticity. Any of the materials, connector configurations, performance characteristics or arrangements of connectors may be selected.

We claim:

1. An electrical connector, comprising;

(a) an insulation-displacement surface;

(b) a retaining surface;

(c) a metal that at constant temperature has a recoverable strain of at least 0.8% positioned to control the positions of said displacement surface and said retaining surface relative to one another; and (d) said insulation-displacement surface and said retaining surface being positioned relative to one another such that an electrical conductor having an insulating jacket can be forced between said surfaces to displace the insulating jacket and cause recoverable of said metal.

2. A connector according to claim 1, in which the metal comprises nickel and titanium.

3. A connector according to claim 1, in which the metal is capable of existing in austenite and martensite phases.

4. A connector according to claim 1, in which the metal comprises cold-worked martensite.

5. A connector according to claim 4, in which recoverable deformation of the metal results in a martensite-martenite transformation.

6. A connector according to claim 1, in which the metal if linear superelastic has an average modulus of at least 30000 MPa and if non-linear superelastic has an average modulus of at least 4000 Mpa.

7. A connector according to claim 1, in which the metal comprises austenite at a temperature above $A_S$, recoverable deformation resulting in stress-induced martensite.

8. A connector according to claim 1, in which the displacement surface and the retaining surface are interconnected by the metal.

9. A connector according to claim 1, in which the displacement surface, the retaining surface and the metal are integral with one another.

10. A connector according to any of claims 1 in which the displacement surface comprises said metal.

11. A connector according to any of claims 1, in which the retaining surface comprises said metal.

12. A connector according to any of claims 1 in which the displacement surface and the retaining surface are substantially indentical.

13. A connector according to any of claims 1, which comprises a slotted-beam insulation displacement connector.

14. A connector according to claim 13, in which the slot between the beams at one position therealong can accommodate insulated conductors therein of a diameter range of a factor of at least 3.125 with electrical contact being made between a beam and the conductor.

15. A connector according to claim 13, in which the length of the slot is less than 10 mm.

16. A connector according to claim 13, in which at least a portion of the slot has substantially parallel sides spaced from 0.2–0.6 mm apart.

17. A connector according to claim 14, in which the slot terminates in an arc of greater than 180° having a radius of 0.1–0.5 mm.

18. A connector according to any of claims 14 in which the beam has a width perpendicular to the slot and at the base of the slot of less than 4.5 mm.

19. A connecting device, which comprises at least two connectors according to claim 1 and a switch, the two connectors being electrically interconnectable by the switch.

20. A connecting device according to claim 19, in which the switch comprises two conductive surfaces resiliently biased to contact one another, but separable from one another.

21. A connecting device according to claim 19, in which the switch comprises two conductive surfaces fixed apart from one another, the two conductive surfaces having means for retaining a conductor that can bridge them.

22. A connection apparatus which comprises an array of at least 10 connectors according to claims 1.

23. A connection apparatus which comprises a housing and a connector according to claims 1 mounted therein, a part of the housing contributing to the functioning of the connector.

24. A connection apparatus according to claim 22, having the form of a telecommunications terminal block.

25. A connecting device according to claims 19, which additionally comprises means for providing environmental protection.

26. A connecting device according to claim 25, in which the means for providing environmental protection comprises a gel.

27. A method of making an electrical connection which comprises (1) providing an electrical connector having an electrical contact and comprising a metal that at constant temperature has a recoverable strain of at least 2%;

(2) positioning an electrical conductor adjacent the electrical contact; and (3) forcing the conductor into contact with the contact against the recoverable strain of the metal.

28. A method according to claim 27, in which the conductor is insulated and in which the contact comprises an insulation-displacement surface, step (3) causing insulation-displacement of the insulated conductor.

29. A method according to claim 27, in which steps (2) and (3) are carried out at substantially the same temperature.

30. A method according to any of claims 27, in which the connection comprises a slotted-beam insulation displacement connector, step (3) comprising sliding the connector substantially perpendicular to its length along the slot.

31. A method of making an electrical connection between two electrical conductors, which comprises connecting each conductor to a respective electrical contact by a method according to any of claims 27, and connecting together the electrical connectors.

32. A method of making an electrical connection between two electrical conductors, which comprises connecting one of the conductors to an electrical contact by a method according to any of claims 27 and connecting the other electrical conductor to a part of the electrical connector remote from a part of the contact to which the first-mentioned conductor is or is to be connected.

33. A slotted-beam insulation-displacement connector comprising a metal that has a recoverable strain of at least 0.8%, against which recoverable strain the connector is deformed when a conductor to be connected thereto is forced into its slot.

* * * * *